US005221293A

United States Patent [19]

Ferlemann et al.

[11] Patent Number: 5,221,293

[45] Date of Patent: Jun. 22, 1993

[54] GRINDING OR SEPARATING TOOL AND METHOD FOR PRODUCING THE SAME

[75] Inventors: Felix Ferlemann, Ratingen; Josef Sauren, Fürth; Theodor v.Bennigsen-Mackiewicz, Henstedt-Ulzburg, all of Fed. Rep. of Germany

[73] Assignees: Firma Ernst Winter & Sohn (GmbH & Co); Fraunhofer-Gesellschaft zur Förderung der angewandten Forschung e.V., Hamburg, Fed. Rep. of Germany

[21] Appl. No.: 842,075

[22] Filed: Feb. 26, 1992

[30] Foreign Application Priority Data

Feb. 26, 1991 [DE] Fed. Rep. of Germany ..... 4106005

[51] Int. Cl.[5] ..... B24B 1/00

[52] U.S. Cl. ..... 51/295; 51/293; 51/298; 51/307; 51/309

[58] Field of Search ..... 51/293, 295, 298, 307, 51/309

[56] References Cited

U.S. PATENT DOCUMENTS

| | | | |
|---|---|---|---|
| 4,021,209 | 5/1977 | Binkley | 51/293 |
| 4,668,248 | 5/1987 | Dettelbach et al. | 51/293 |
| 4,964,884 | 10/1990 | Jürissen et al. | 51/295 |
| 5,079,875 | 1/1992 | Unno et al. | 51/293 |

*Primary Examiner*—Mark L. Bell
*Assistant Examiner*—Willie J. Thompson
*Attorney, Agent, or Firm*—Michael J. Striker

[57] ABSTRACT

A grinding or separating tool has a base body with a synthetic plastic matrix and a plurality of reinforcing fibers, a working coating a plurality of hard grains, and an intermediate layer applied on the base body and located between the base body and the working coating so that the fibers of the base body extend outwardly beyond the plastic matrix of the base body and are embedded in the intermediate layer.

21 Claims, 2 Drawing Sheets

GRINDING OR SEPARATING TOOL AND METHOD FOR PRODUCING THE SAME

BACKGROUND OF THE INVENTION

The present invention relates to a grinding or separating tool and a method of producing the same.

More particularly, it relates to a grinding or separating tool which has a fiber-reinforced base body with a synthetic plastic matrix, and a working coating of hard material such as diamond grains or boron nitride grains held in a binder.

Grinding tools and separating tools such as saws generally have a working coating composed of active hard material and a base body on which the working coating is mounted. In addition to the hard materials, the working coating also includes a binder for the hard materials. The binder can be a metal, a synthetic resin or ceramic. In certain cases the working coating also has various fillers, depending on the application of the diamond tools.

The base body which has no hard materials but instead performs only the functions of a support for the hard material working coating usually is composed of metal, such as for example aluminum or steel, or of synthetic plastic resin such as for example phenol resin, epoxy resin or polyamide resin. It is known also to provide the synthetic resin with admixtures such as for example metal powder, graphite powder, or fiber structures such as carbon fibers or glass fibers.

Both the working coating and the base body must satisfy very high requirements with respect to the strength, the temperature resistance, the hydraulic resistance and the chemical resistance. Moreover, they must satisfy the requirements of the heat conductivity and the vibration damping. These requirements can be partially satisfied by the use of temperature resistant duroplastic synthetic plastic resins with admixtures of metal powders or graphite.

In earlier time there was a tendency of increasing the cutting speed or the peripheral speed, especially of peripheral grinding discs and saws. The development of high speed grinding and separating tools led as a rule to greater diameters of the discs, since otherwise with conventional machines very high peripheral speeds of more than 250 m/s could not be achieved without problems. On the other hand, high peripheral speeds can be obtained only when the base body has high E-modulus (elasticity modulus) with low density so that the tool does not substantially expand or spring, but instead can take into consideration relatively low loads and expansions. The earlier developments therefore led to utilization of fiber reinforced-composite materials which have a high strength with low weight. This is true especially for the use of carbon fiber-reinforced synthetic resin compound materials which are generally identified as CFK.

In such fiber-reinforced base bodies of synthetic plastic material for high speed tools there is however a problem related to the connection of the base body with the working coating. It is known to connect the working coating with the base body by adhesives. However, this method can result in strength which in many cases does not satisfy the requirements of the high speed grinding. It has been found that the working coatings can be anchored mechanically in the base body or laminated in the base body with a web. Such solutions are however expensive and lead to an increase of the mass of the tool and in some cases to non-uniform mass distribution, so that an additional equalization must be provided.

SUMMARY OF THE INVENTION

Accordingly, it is an object of the present invention to provide a grinding or separating tool which avoids the disadvantages of the prior art.

More particularly, it is an object of the present invention to provide a grinding or separating tool in which the connection between the working coating and the fiber reinforced base body for a high speed working is improved so that the danger of jumping or springing out of the working coating from the base body is prevented.

In keeping with these objects and with others which will become apparent hereinafter, one feature of the present invention resides, briefly stated, in a grinding or separating tool in which, in order to increase the adhesion between the working coating and the base body an intermediate layer of metal is provided between the working coating and the base body by applying the intermediate layer on the base body in a galvanic or currentless manner, and the fibers which are anchored in the synthetic plastic material of the base body and project beyond it are embedded in the intermediate layer.

Due to the mechanical properties, the arrangement, density and thickness of the connecting fibers, the adhesive strength of the working coating with the base body is significantly improved.

The working coating can be glued on the intermediate layer which is applied galvanically or currentlessly. Therefore a better adhesion is obtained then in the case when gluing was performed on the base body of synthetic plastic material. The metallic intermediate layer acts in an especially advantageous manner when a working coating is applied galvanically so that the hard grains of diamond or boron nitride are bound by electric current in a metal matrix for example of nickel or copper.

Instead of an electrolytic metal deposition of the intermediate layer on the base body, a currentless metal deposition by reduction process can be used as well. A currentless metal deposition of nickel or copper can be performed in an aqueous solution composed of nickel or copper salts and a reduction agent such as for example hypophosphite. This provides for a chemical currentless deposition.

In order to provide the connection of the electrically conductive fibers, the fibers can be composed of metal such as for example steel, aluminum, copper. Also, electrically conductive carbon fibers can be used as well. Fibers can be exposed by removing the synthetic plastic matrix of the base body. This can be obtained by etching for example by the use of an acid such as sulfuric acid. A removal of the synthetic plastic matrix of the base body relative to the tips of the fibers can be preferably between 20 and 300 micrometers. The thusly released space is galvanically metallized so as to form the intermediate layer, and the preliminary exposed fiber portions extend to form an anchoring. The fibers can be arranged in different orientations and preferably with the use of fiber fabrics or fiber mats which are located near one another and thus embedded in the synthetic plastic.

In order to provide a definite orientation of the fibers and thereby increased strength the preliminarily impregnated fabric can be arranged in layers which are heated together with the synthetic plastic of the base body so that they are impregnated by the synthetic plastic material and compressed together with it. Therefore first a large disc is produced, from which a plurality of small base bodies can be made.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
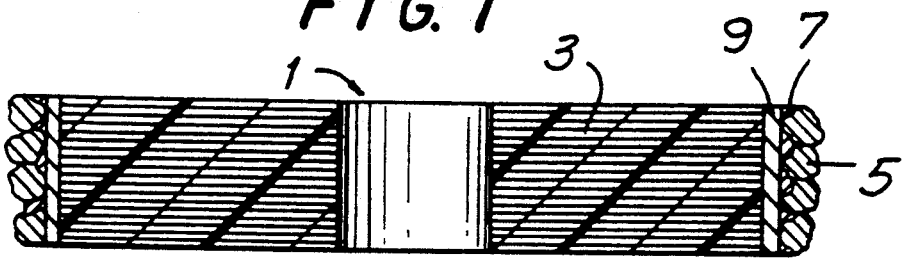
FIG. 1 is a view showing a peripheral grinding disc in accordance with the present invention.
Figure 2:
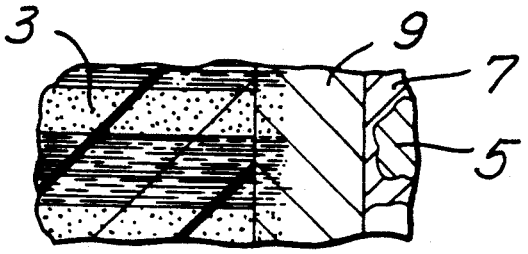
FIG. 2 is a view showing an outer edge portion the grinding disc of the invention on a large scale.

A peripheral grinding disc formed in accordance the present invention is identified as a whole with reference numeral 1. It includes a base body identified with reference 3 and a working coating supported by the base body. The base body 3 is a carbon fiber-reinforced body composed of synthetic plastic material. The working coating includes a plurality of diamond grains 5 which are retained in a metallic binder, for example of nickel or copper. An intermediate layer is arranged between the base body 3 and the working coating and applied on the base for example galvanically. Fabric mats 11, 13 and 15 of electrically conductive carbon fibers are embedded in the base body 3 composed of an epoxy-polyamide or a phenol resin. The fibers of various fabric mats are oriented different relative to one another. In other words, the fibers of the mat 11 are for example oriented differently than the fibers of mat 13 and the fibers of the mat 15.

The galvanically deposited intermediate layer 9 improves the adhesion the base body 3 on the one hand and the working composed of the hard material grains 5 and the binder 7. This is obtained in that the fiber portions which freely project beyond the base body 3 extend into the intermediate layer 9. In order to achieve this, the synthetic plastic matrix of the base body 3 is removed by etching for example with the use of a sulfuric acid, by approximately up to 300 um relative to the fiber ends. In the thusly produced free space between the free fiber ends and the remaining synthetic plastic matrix of the base body 3, the galvanically deposited intermediate layer 9 is located. Due to the increased adhesion surface the intermediate layer 9 is homogeneously connected with the base body and is suitable for receiving the working coating composed of the grains 5 and the binder 7. When a metal such as nickel is used as the binder, the coating can be applied on the intermediate carrier galvanically. Basically there is also a possibility to work the outer side of the intermediate layer after its application so as to glue or press subsequently a working coating of a different material. In all cases it is advantageous that the adhesion between the working coating and the base body 3 of synthetic plastic material is greater due to the intermediate layer than in the cases when a connection of the working coating directly with the base body of fiber-reinforced synthetic plastic was provided.

Figure 3:
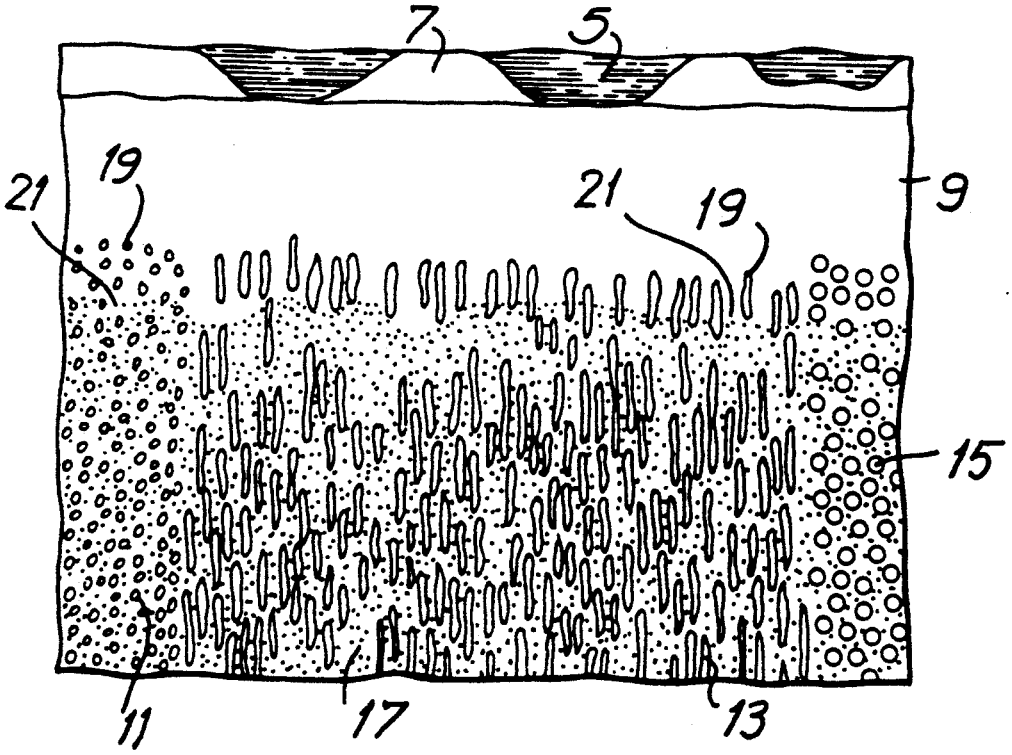
FIG. 3 is a view showing a section through the outer edge of the grinding disc in accordance with the present invention, amplified several hundredth times.

From the view of FIG. 3 which shows a microscopic structure amplified several hundredth times, it can be seen individual fibers in various fabric mats 11, 13 and 15 are oriented uniformly in each mat but differently relative to another, and the fabric mats are impregnated with synthetic plastic material 17. The removal of the synthetic plastic matrix relative to the outwardly located fiber ends 19 is performed by etching in the magnitude which forms a synthetic plastic outer side 21, and the usual fibers 19 of different fiber mats extend freely beyond the outer side 21. The thusly produced free intermediate space is filled by a galvanic deposition of the intermediate layer 9 composed of nickel, cobalt or another metal. An electrical conductivity of the individual fibers of the fabric mats composed for example of carbon or in other words carbon fibers is presumed, and thereby high mechanical loads can be also withstood.

Figure 4:
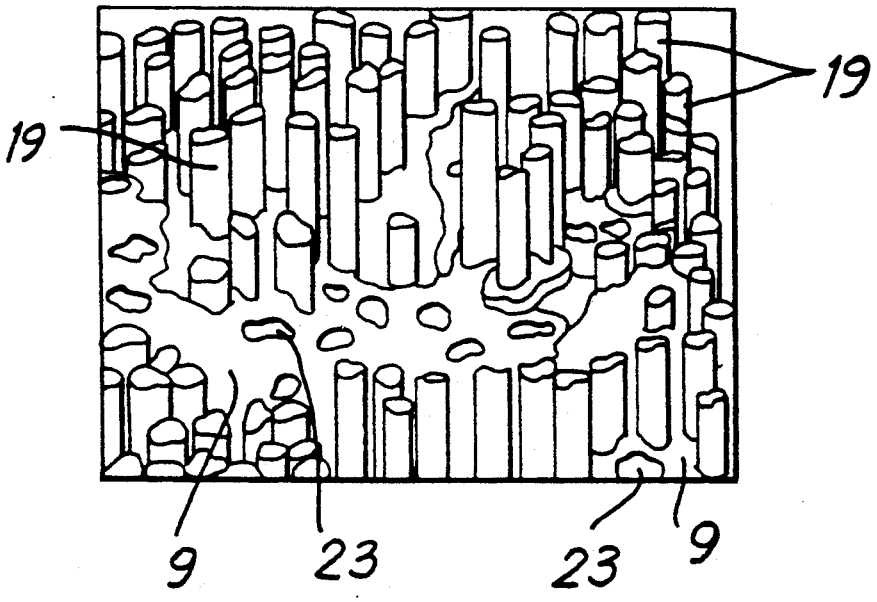
FIG. 4 is a microscopic view of an intermediate layer of the invention peripheral grinding disc.

FIG. 4 shows a microscopic structure of a portion of the intermediate layer in which the individual fibers 19 of the base body 3 are extended. After removing a small part of an intermediate layer from the base body it can be seen microscopically that pipe-like structure or passages 23 are formed in the intermediate layer 9, formed by the fibers 19 of the base body 3.

It will be understood that each of the elements described above, or two or more together, may also find a useful application in other types of constructions differing from the types described above.

While the invention has been illustrated and described as embodied in a grinding or separating tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A grinding or separating tool, comprising a base body composed of a synthetic plastic matrix and a plurality of electroconductive reinforcing fibers; a working coating including a plurality of grains located in a binder; and a metal intermediate layer located between said base body and said working coating so that said fibers of said base body extend outwardly beyond said synthetic plastic matrix and into said intermediate layer to improve connection between said base body and said working coating.

2. A grinding or separating tool as defined in claim 1, wherein said grains of said working coating are composed of a material selected from the group consisting of diamond grains and boron nitride grains.

3. A grinding or separating tool as defined in claim 1, wherein said fibers are oriented in said base body in a uniform manner.

4. A grinding or separating tool as defined in claim 1, wherein said fibers in said base body are oriented differently.

5. A grinding or separating tool as defined in claim 4, wherein said base body includes a plurality of fiber layers, said fibers in one of said layers being oriented differently than said fibers in another of said layers.

6. A grinding or separating tool as defined in claim 5, wherein said fibers in each individual one of said layers are oriented uniformly.

7. A grinding or separating tool as defined in claim 1, wherein said fibers for said base body are formed as carbon fibers.

8. A grinding or separating tool as defined in claim 1, wherein said fibers of said body are composed of an electrically conductive synthetic plastic material.

9. A grinding or separating tool as defined in claim 1, wherein said working coating also includes a binder in which said grains are located, said binder being composed of metal, said intermediate layer being composed of the same metal of which said binder is composed.

10. A grinding or separating tool as defined in claim 1, wherein said intermediate layer is composed of a metal selected from the group consisting of nickel, cobalt and copper.

11. A method of producing a grinding or separating tool comprising the steps of providing a base body having a synthetic plastic matrix and a plurality of electroconductive reinforcing fibers; providing a working coating composed of a plurality of hard grains located in a binder; applying a metal intermediate layer onto said base body so that the reinforcing fibers project outwardly beyond the synthetic plastic matrix and are embedded into the intermediate layer; and arranging the working coating on the intermediate layer to improve connection between said base body and said working coating.

12. A method as defined in claim 11; and further comprising the step of removing a part of the synthetic plastic material of said base body so as to partially expose the reinforcing fibers.

13. A method as defined in claim 12, wherein said removing of a part of the synthetic plastic matrix includes etching the synthetic plastic matrix so as to remove its part.

14. A method as defined in claim 11, wherein said applying the intermediate layer includes galvanically depositing the intermediate layer on the base body.

15. A method as defined in claim 11, wherein said mounting of said working coating includes galvanically depositing of the working coating on the intermediate layer.

16. A method as defined in claim 11, wherein said mounting of the working coating includes gluing the working coating on the intermediate layer.

17. A method as defined in claim 11, wherein said mounting of the working coating includes pressing the working coating on the intermediate layer.

18. A method of producing a grinding or separating tool comprising the steps of providing a base body having a synthetic plastic matrix and a plurality of reinforcing fibers; providing a working coating composed of a plurality of hard grains located in a binder; applying an intermediate layer onto said base body so that the reinforcing fibers project outwardly beyond the synthetic plastic matrix and are embedded into the intermediate layer; arranging the working coating on the intermediate layer to improve connection between said base body and said working coating; and removing a part of the synthetic plastic material of said base body so as to partially expose the reinforcing fibers, said removing being performed by etching the synthetic plastic matrix with an acid.

19. A method as defined in claim 18, wherein said etching includes etching with sulfuric acid.

20. A grinding or separating tool, comprising a base body composed of a synthetic plastic matrix and a plurality of reinforcing fibers; a working coating including a plurality of grains located in a binder; and as intermediate layer located between said base body and said working coating so that said fibers of said base body extend outwardly beyond said synthetic plastic matrix and into said intermediate layer to improve connection between said base body and said working coating.

21. A method of producing a grinding or separating tool comprising the steps of providing a base body having a synthetic plastic matrix and a plurality of reinforcing fibers; providing a working coating composed of a plurality of hard grains located in a binder; applying an intermediate layer onto said base body so that the reinforcing fibers project outwardly beyond the synthetic plastic matrix and are embedded into the intermediate layer; and arranging the working coating on the intermediate layer to improve connection between said base body and said working coating.

* * * * *